United States Patent [19]

Johnston

[11] Patent Number: 5,056,843

[45] Date of Patent: Oct. 15, 1991

[54] SAFE-T-BOX CARRIER

[76] Inventor: Al Johnston, 14252 Culver Dr., Ste. A-689, Irvine, Calif. 92714

[21] Appl. No.: 550,178

[22] Filed: Jul. 9, 1990

[51] Int. Cl.[5] ..... B66C 1/16; B66C 1/42

[52] U.S. Cl. ..... 294/27.1; 294/152

[58] Field of Search ..... 294/27.1, 15, 16, 25, 294/31.2, 32, 74, 137, 151, 152, 165

[56] References Cited

U.S. PATENT DOCUMENTS

| | | | |
|---|---|---|---|
| 1,113,393 | 10/1914 | Winans | 294/152 |
| 1,574,927 | 3/1926 | Otto | 294/25 X |
| 2,602,688 | 7/1952 | Brunk | 294/27.1 X |
| 2,676,835 | 4/1954 | McKinney | 294/74 |
| 3,211,489 | 10/1965 | Gill | 294/31.2 |
| 4,226,349 | 10/1980 | Uccellini | 294/15 X |

*Primary Examiner*—Margaret A. Focarino
*Assistant Examiner*—Dean J. Kramer

[57] ABSTRACT

A detachable, and versatile hand article carrier for lifting, transporting, moving boxes as well as small commercial store boxes to be used by either one person or in combination two persons. Having two frames (11A and 11B) with two rectangle sides (C and D) formed right angle to each other, for fitting along two sides of boxes, a horizontal bottom lip (10A and 10B) formed right angle to one side, for fitting on the third connecting box side. A flexible element (14) connects the two frames by attachments (15) in a horizontal manner so as to hold the frames securely in place, and to support the load being transported. Both frames have attached handles (12A and 12B) for grasping, picking up, and transporting the load once the frames are inserted.

1 Claim, 6 Drawing Sheets

FIGURE 3A
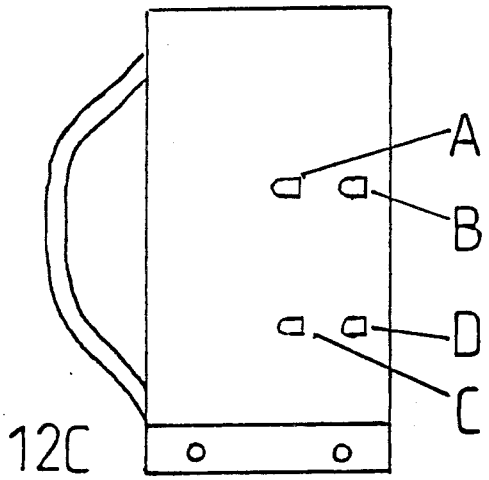
FIGURE 3B
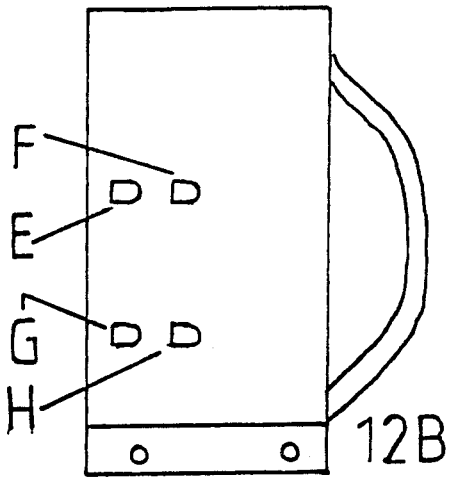
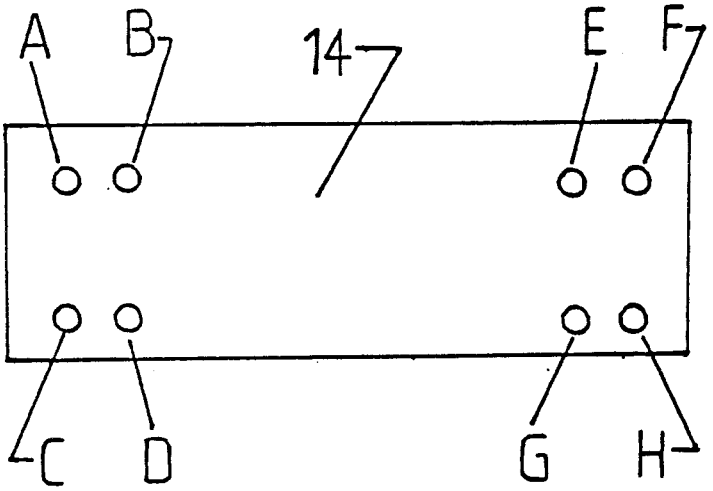
FIGURE 3C

FIGURE 6A
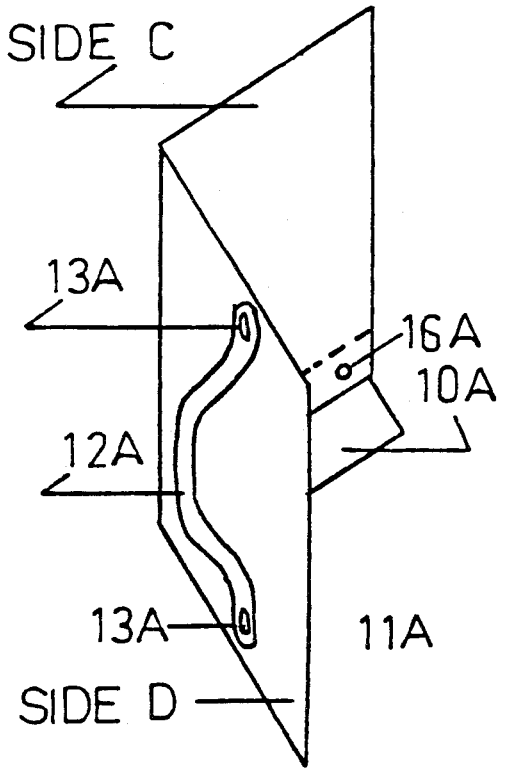
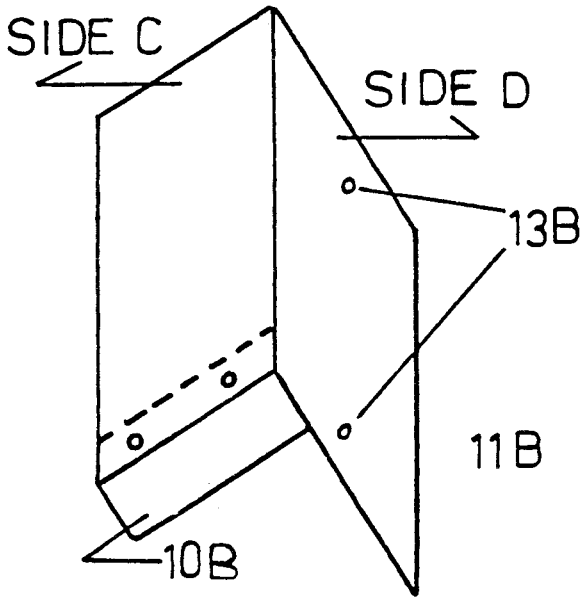
FIGURE 6B

SAFE-T-BOX CARRIER

BACKGROUND

1. Field of Invention

This invention relates to an article carrier, and more particularly to support and carry a box(es), safely, both to carrier and items inside, which may readily be removed.

2. Description of Prior Art

In the United States, 20% of the population moves annually. A typical one man box is rectangular and may have approximate dimensions of 17"×12"×13" deep. The box is generally used to carry miscellaneous items from one place to another. Household as well as commercial, (such as grocery store boxes), moving and storage boxes have no handles or supports for moving. They are difficult for one person to pick-up, carry, and sit-down. All of us have experienced the impossible task of forcing our hands under a full box, attempting to lift, only to feel the pain of a broken finger nail, or scraped skin, once under the box, the average male or female struggles to lift the heavy box. As the person moves from one place to another, box in hand, the fingers become weak or slippery, causing the box to slip from the person. If the person carrying the box makes it to his destination, more difficulty is encountered with lowering the box to the ground safely without smashing his fingers. The larger two man boxes are typically 22"×16"×16" deep. The same problem exists in picking-up, transporting by hand, and sitting down.

SUMMARY OF THE INVENTION

The SAFE-T-BOX CARRIER comprises of a pair of portable light weight lifting frames with vertical grasping handles. With one easy motion a person can grasp a box, secure very fast, lift with leverage, carry with ease, and sit down safely. The invention features a unique system for easy mounting and removal on the far bottom opposite corners of a one man box. The invention has a small lip, [used for leverage and support,] on the bottom of each pair, which is quickly, and easily fitted under the opposite bottom side of a box corner. Further support and lifting power comes from a wide, thin, strong, flexible elastic band attached between the frame of the carriers, which is easily stretched between the two far corners of the box while the person is securing the lip under the box. Thus, acting as a firm holding force between the two portable carrier frames. Also the thin elastic band acts as a safety line across the back of the box. The working model has shown the versatility of the invention, by using the device with the handles in the vertical as well in the horizontal position.

A large two man box or article can easily be move by two pairs of SAFE-T-BOX CARRIERS. Each man attaches one pair quickly, and conveniently, to the bottom two corners closest to the person. [The one man box attachment is on the far opposite side]. The thin elastic band is now stretch easily under the box, at the same time pushing the thin right side of the frame under the box until the lip portion is snugly against the box side facing the box carrier. The grasping area of the invention will now be Horizontal instead of Vertical.

In both cases the SAFE-T-BOX CARRIER is used to quickly secure, safely pick up, transport, easily by hand, and safely set boxes down, at the same time quickly and conveniently remove the invention from the box. In general the object of this invention is to prove a strong light weight, low price, durable, easy to build, tool that is convenient to use, easy to secure, and remove, as well as safety for the person moving the box and the objects inside the box. And provide greater leverage power in picking up, carrying, and sitting down a box.

Another object of this invention is to provide two people the above character but with the use of two SAFE-T-BOX CARRIERS to move a two man box.

Another object of this invention is to have the above character but with interchangeable lengths of elastic bands for different size boxes.

Another object of the invention is have the above character but without the elastic band support.

Another object of the invention is to have the above character but with handles that pivot from horizontal to vertical at the option of the user.

BRIEF DESCRIPTION OF THE DRAWINGS

Many other advantages of the invention will appear from the following detailed description of my practical embodiment of the same, taken with the accompanying sheet of drawings, which I will now describe.

FIG. *3a–3c* is the back view of the elastic material showing how hooks would work as the attachments to the frame.

Figure 4:
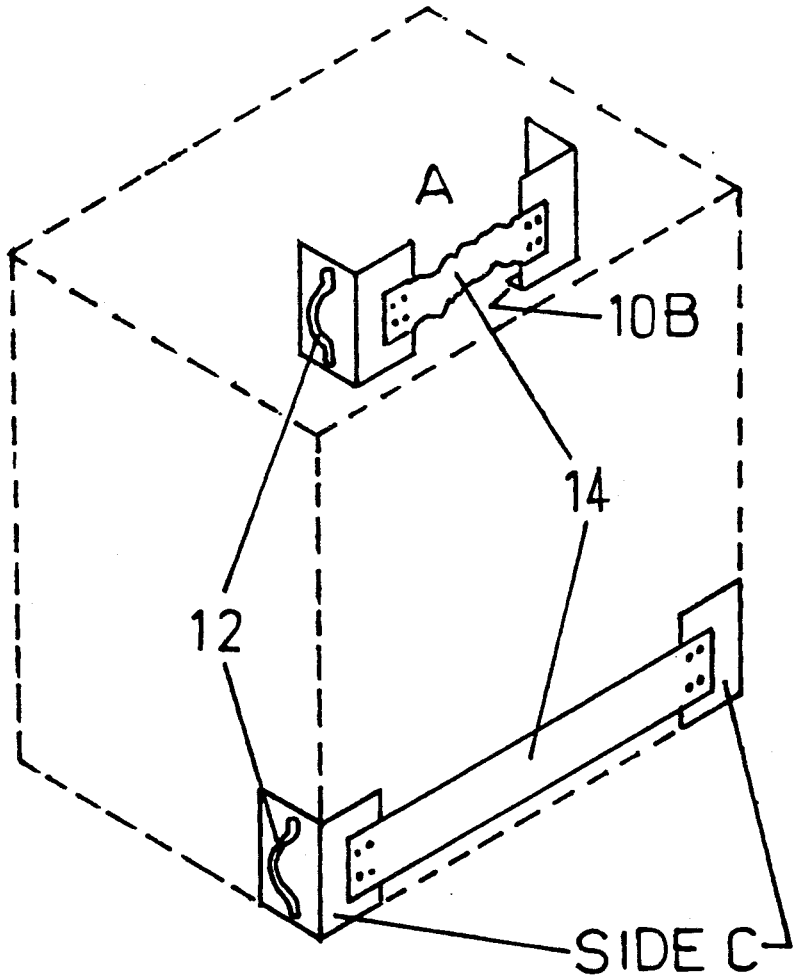

FIG. 4 is a view of the devise in two positions, one with elastic element in the relax form, the other is after the elastic element is stretched across the back of a box to each corner.

Figure 5:
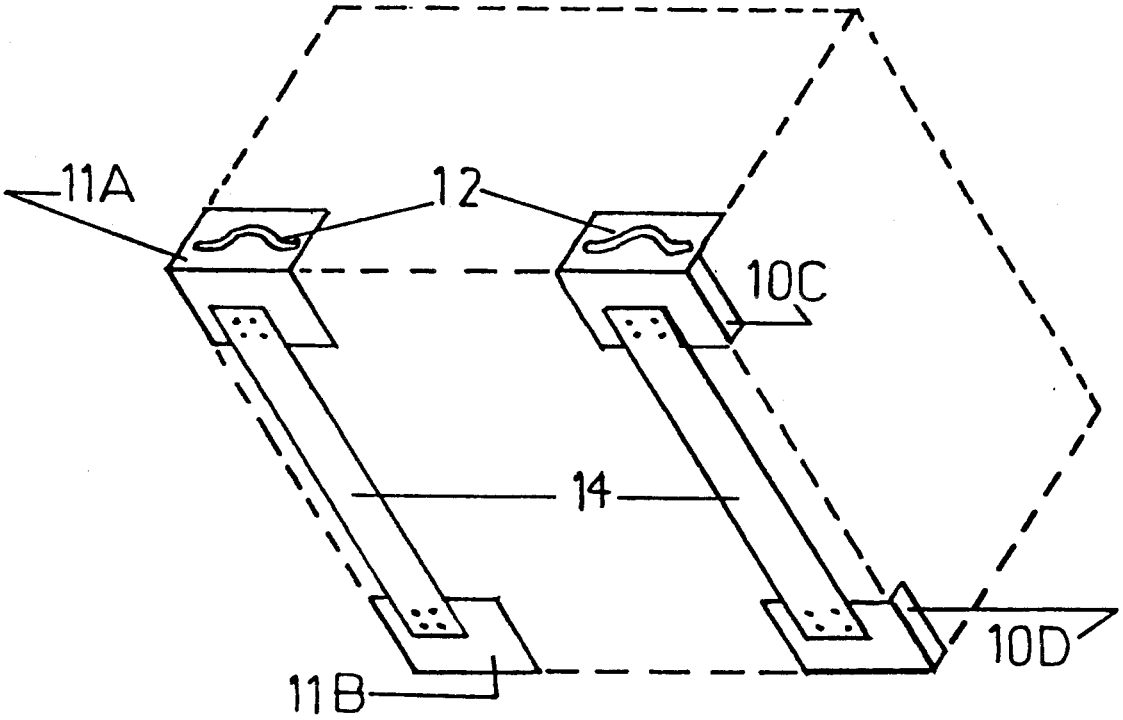

FIG. 5 is a perspective BOTTOM view showing the invention with the devise turned over so the flexible element is now under the box and the bottom lip is on the side of the box. Two pairs of SAFETY-T-BOX CARRIERS are used.

FIG. 6 is a perspective view of both frames showing no attachment, (flexible element), to the frames.

DESCRIPTION OF THE PREFERRED EMBODIMENT(S)

Figure 1:
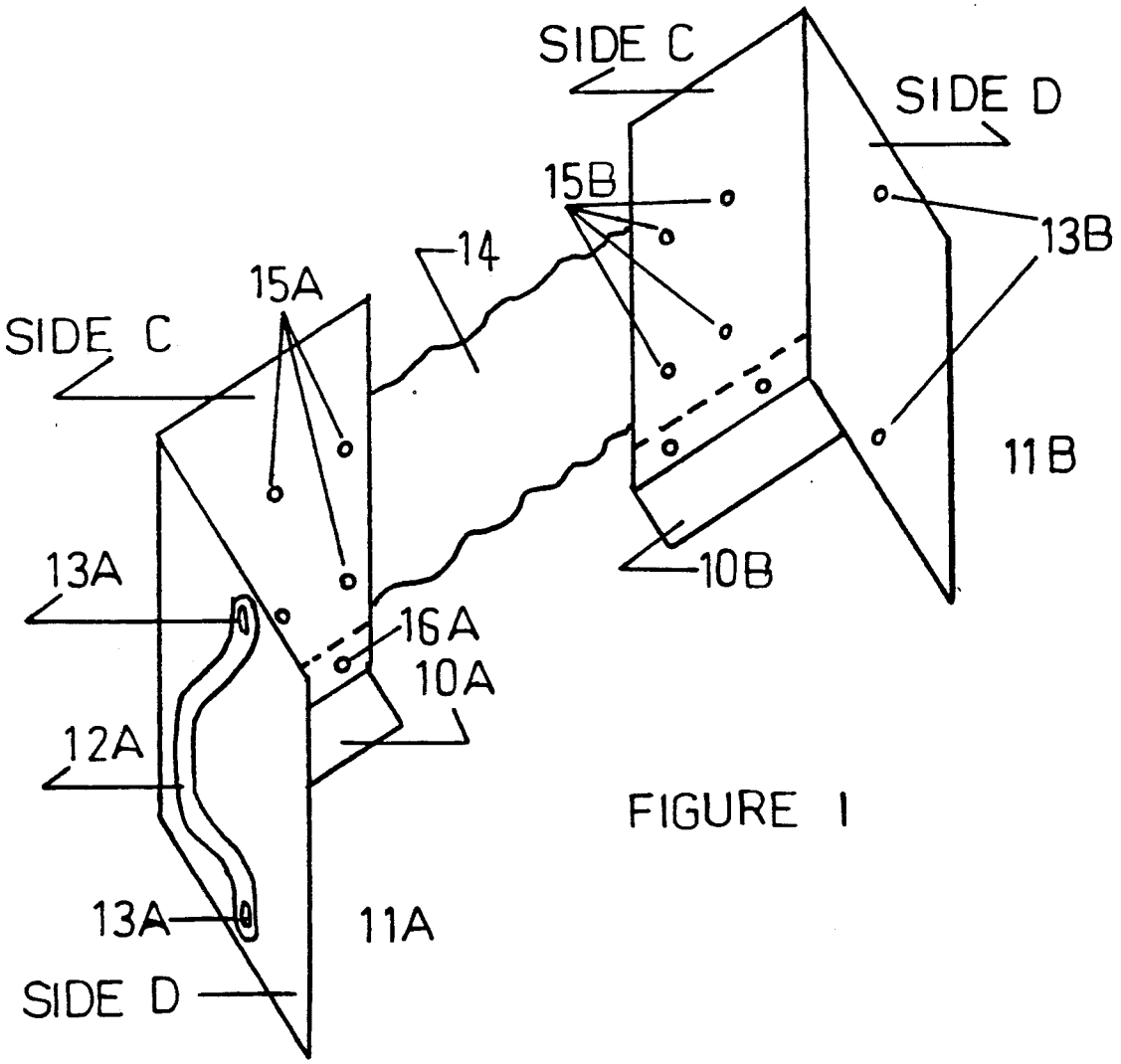
FIG. 1 is a detailed perspective view of the invention as used on a one man box.

Referring now to FIG. 1, I will describe the SAFE-T-BOX CARRIER. The 11A & 11B frames are formed with two rectangle sides right angle to each other. The 12A & 12B handles are attached to the center of SIDE D of 11A & 11B frame with 13A & 13B attachments. The 14 elastic element, is attached to the center of side C, 11A 7 11B frame with 15A & 15B attachments, [screws & bolts, hooks, or other convenient attachments.], Note: The working model used screws and bolts. If the hooks are used the attaching side of the hook will be facing away from opposite pair, as shown in FIG. 3. The 10A and 10B lip are formed right angle to Side C, and horizontal to the bottom of SIDE D, and attached to 11A & 11B frame SIDE C, bottom with 16A & 16B attachments. Note: the working model used screws and bolts for greater support, and lifting power.

Figure 2:
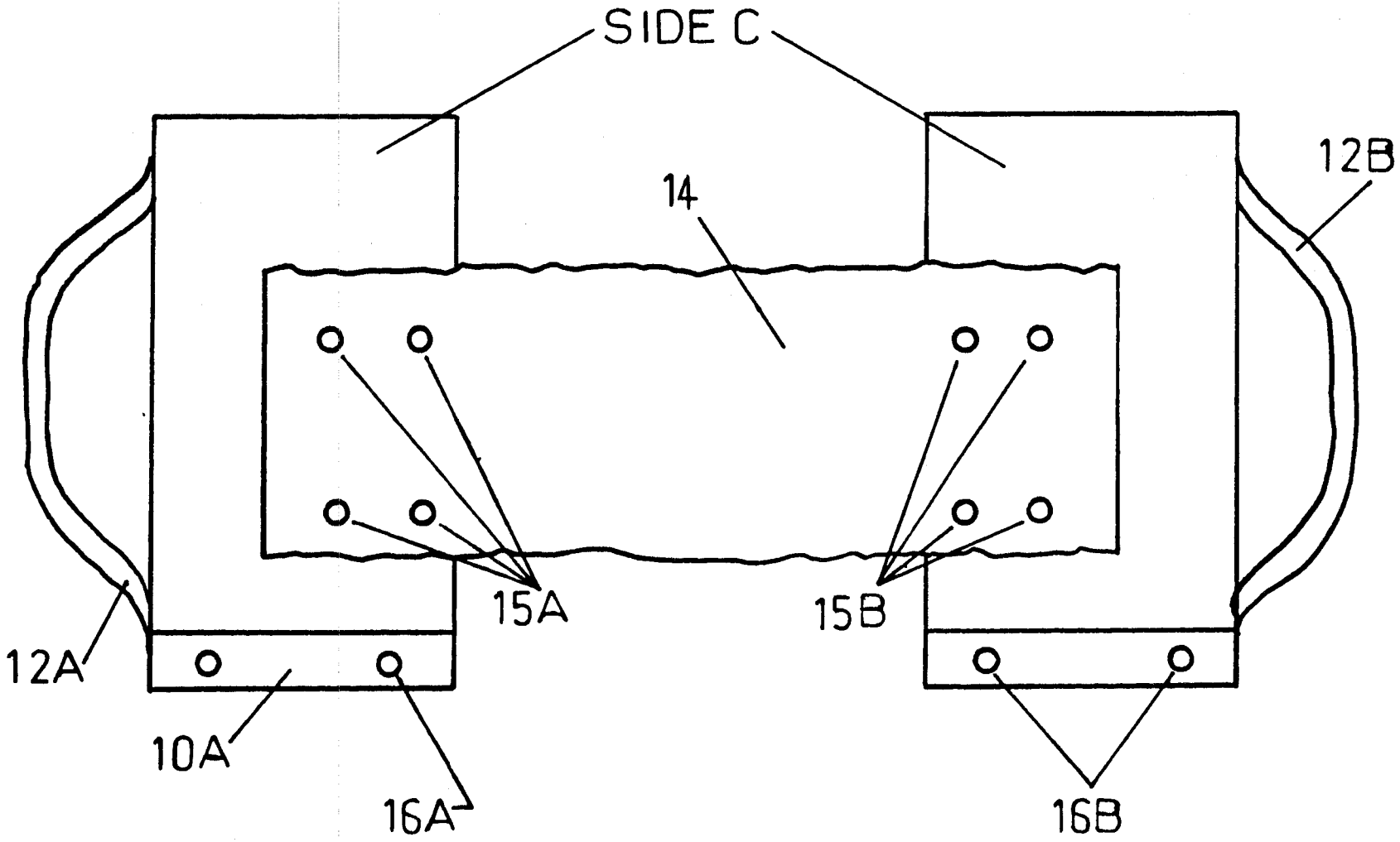
FIG. 2 is a detailed back view of the invention.

FIG. 2 shows the back rectangle side C of both frames with 14 elastic element attached with 15A & 15B attachments secured to center of SIDE C of 11A & 11B frame. Back of 10A & 10B lip is attached with 16A & 16B attachments, or as suited, for strong lifting support, to SIDE C, of 11A & 11B.

FIG. 3 shows 14 elastic element with A,B,C,-D,E,F,G,H, holes to fit A,B,C,D,E,F,G,H. Attachments of 11A & 11B frame, SIDE C. as shown the different size bands can easily interchange according to the size of box. BUT PLEASE NOTE: ONE SIZE BAND, AS PROVED WITH THE WORKING MODEL, CAN STRETCH TO SEVERAL SIZE BOXES. Greater convenience is provided by using only one size band that fits box sizes of several different dimension.

FIG. 4 shows the device in two positions. A person stands with arms extended across the top of the box with elastic element 14 in the relaxed position as per A. The hands hold on the 12 handles of each frame 11A and 11B. In one fast motion the frames are moved over the top then down the back side, at such time the elastic element 14 is stretched across the back side and the lip areas 10A and 10B are securely placed under the box, with side C and Side D of frame on each of the other two adjoining box sides.

FIG. 5 shows two devices, or four frames, being used on a large box. The view is the bottom of a box with the four frames attached to the box. 11A & 11B frame is attached quickly by one person to the box, at the same time 11C & 11D frame is attached quickly by a second person. At the same time the two people stretch 14 flexible element the full length of the box, then slide the FRAME AND THE FLEXIBLE ELASTIC ELEMENT under box, both movers allow the frame to be pull back towards the box BY THE ELASTIC ELEMENT thereby, attaching to the corners snugly. The 12B & 12D handles are horizontal to the top. The 10C & 10D support lips are now on the side of the box.

FIG. 6 shows frames 11A and 11B without Attachments 15A and 15B and (no Attachment) without the 14 elastic element attached to either frame. Therefore, each frame can easily fit independently of each other, and attached to an article without the need to stretch the Elastic Element 14 across the far corner.

It is apparent from the forgoing that there has been provided a new and useful tool which has many versatile advantages. Because of the ease of operation, the mover will be able to move one and two man boxes with ease and safety.

I claim:

1. A tool consisting of two identical frames, each of said frames having two rectangular sides formed perpendicular to each other, with a substantially rectangular bottom lip mounted to and extending at a right angle from one said side and extending along the bottom of the opposite side, handles are attached to one said side of each frame, said handles centered on one said side, and a flexible element which is attached to one said side of each frame connects the two frames in order to grip at least one side of a load.

* * * * *